US006226820B1

(12) United States Patent
Navarro

(10) Patent No.: US 6,226,820 B1
(45) Date of Patent: May 8, 2001

(54) GEL PAD WITH INTEGRAL SHAPE RETAINER

(75) Inventor: Richard Navarro, Strongsville, OH (US)

(73) Assignee: Polymer Concepts, Inc., Cleveland, OH (US)

( * ) Notice: Subject to any disclaimer, the term of this patent is extended or adjusted under 35 U.S.C. 154(b) by 0 days.

(21) Appl. No.: 09/351,522

(22) Filed: Jul. 12, 1999

(51) Int. Cl.[7] ..... A47C 27/10

(52) U.S. Cl. ..... 5/655.5; 5/654; 5/655.4; 5/911; 5/913

(58) Field of Search ..... 5/655.5, 655.4, 5/654, 652, 911, 913

(56) References Cited

U.S. PATENT DOCUMENTS

| | | | | |
|---|---|---|---|---|
| Re. 34,661 | | 7/1994 | Grim | 602/27 |
| 3,608,961 | * | 9/1971 | Von Heck | 5/911 X |
| 3,745,998 | * | 7/1973 | Rose | 5/913 X |
| 3,762,404 | * | 10/1973 | Sakita | 5/911 X |
| 3,830,896 | * | 8/1974 | Flicker et al. | 5/655.4 X |
| 4,045,830 | * | 9/1977 | Loeb et al. | 5/913 X |
| 4,068,655 | | 1/1978 | Leroy | 600/206 |
| 4,114,214 | * | 9/1978 | Von Heck | 5/655.4 X |
| 4,213,213 | * | 7/1980 | Burnett | 5/911 X |
| 4,234,982 | * | 11/1980 | Bez et al. | 5/911 X |
| 4,254,518 | * | 3/1981 | Buhren et al. | 5/913 X |
| 4,347,213 | * | 8/1982 | Rogers, Jr. | 5/913 X |
| 4,370,769 | * | 2/1983 | Herzig et al. | 5/654 |
| 4,389,742 | * | 6/1983 | DeWitt | 5/654 |
| 4,405,129 | * | 9/1983 | Stockey | 5/654 X |
| 4,493,877 | * | 1/1985 | Burnett | 5/913 X |
| 4,672,700 | * | 6/1987 | Poncy | 5/655.5 X |
| 4,885,811 | * | 12/1989 | Hayes | 5/911 X |
| 4,905,998 | | 3/1990 | Last | 607/108 X |
| 4,980,939 | * | 1/1991 | Smith | 5/655.5 X |
| 5,009,318 | * | 4/1991 | Lepinoy | 5/709 X |
| 5,035,241 | | 7/1991 | Walasek et al. | 607/114 |
| 5,103,517 | * | 4/1992 | Krouskop | 5/913 X |
| 5,121,756 | * | 6/1992 | Koledin | 5/913 X |
| 5,154,185 | | 10/1992 | Latimer et al. | 5/655.4 X |
| 5,163,333 | | 11/1992 | Brubaker et al. | 73/865.8 |
| 5,190,033 | | 3/1993 | Johnson | 607/108 |
| 5,399,152 | | 3/1995 | Habermeyer et al. | 602/23 |
| 5,449,379 | | 9/1995 | Hadtke | 607/107 |
| 5,556,169 | * | 9/1996 | Parrish et al. | 5/655.4 X |
| 5,642,544 | * | 7/1997 | Muñoz | 5/655.5 X |
| 5,906,205 | * | 5/1999 | Hiebert | 5/913 X |
| 5,971,006 | * | 10/1999 | Seigerschmidt | 5/913 X |
| 6,032,300 | * | 3/2000 | Bainbridge et al. | 5/655.4 X |
| 6,055,676 | * | 5/2000 | Bainbridge et al. | 5/655.4 X |
| 6,098,209 | * | 8/2000 | Bainbridge et al. | 5/655.4 X |

FOREIGN PATENT DOCUMENTS

| | | | | |
|---|---|---|---|---|
| 1594111 | * | 7/1981 | (GB) | 5/655.5 |

OTHER PUBLICATIONS

Allen Medical System, SnugVac brochure, 1 page (Date Unknown).

* cited by examiner

*Primary Examiner*—Terry Lee Melius
*Assistant Examiner*—Robert G. Santos
(74) *Attorney, Agent, or Firm*—Pearne & Gordon LLP

(57) ABSTRACT

A gel pad assembly includes a flexible gel pad and an adjustable shape retainer integral with the gel pad. A flexible first outer wall cooperates with a flexible inner wall to form a first chamber. A gel is located within the first chamber. A flexible second outer wall cooperates with the inner wall to form a second chamber coextensive with the first chamber. The integral shape retainer is located within the second chamber and is selectively adjustable between a flexible condition wherein the flexible walls are conformable to a variety of desired shapes and a rigid condition wherein the flexible walls are retained in a selected one of the desired shapes. Preferred embodiments of the shape retainer include a vacuum activated bean bag, a plurality of pressurizable chambers, a thermally deformable plastic sheet, and an array of pivot elements which are mechanically clamped together.

11 Claims, 4 Drawing Sheets

GEL PAD WITH INTEGRAL SHAPE RETAINER

BACKGROUND OF THE INVENTION

The present invention is generally related to a gel pad for cushioning a body portion of a person and, more specifically, a gel pad having an adjustable shape retainer integral with the gel pad.

Gel pads are commonly used to cushion body portions of patients during a variety of medical procedures which require that a patient's body or a portion thereof be positioned in a particular manner. Typically, gel pads are used in conjunction with other devices or mechanical positioners which shape the flexible gel pad and secure the patient's body portion. For example, when a gel pad is used as a pediatric positioner, an infant is placed on the gel pad in supine and a rigid tube is placed under the gel pad at the thoracic area so that the chest will remain extended for anterior chest procedures. While such gel pads may adequately perform their intended purpose, such gel pads often require tie straps, VELCRO or other fasteners to secure them in position, which can inhibit access in some procedures, and require separate components which can be lost or misplaced. Accordingly, there is a need in the art for an method and apparatus for cushioning a body portion while retaining the body portion in a desired position during medical procedures, wherein the apparatus is easy to install and remove, can be used with a plurality of body portions in a infinite number of positions, is simple to adjust, does not obstruct the work are around the patient, can be used in a number of medical fields, and preferably does not have separate components which can be lost or misplaced.

BRIEF SUMMARY OF THE INVENTION

The present invention provides a gel pad which overcomes at least some of the disadvantages of the related art. According to the present invention, the gel pad includes a flexible inner wall, a flexible first outer wall cooperating with the inner wall to form a first chamber, gel located within the first chamber, and a flexible second outer wall cooperating with the inner wall to form a second chamber coextensive with the first chamber. An integral shape retainer located within the second chamber and selectively adjustable between a flexible condition wherein the flexible walls are conformable to a variety of desired shapes and a rigid condition wherein the flexible walls are retained in a selected one of the desired shapes

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
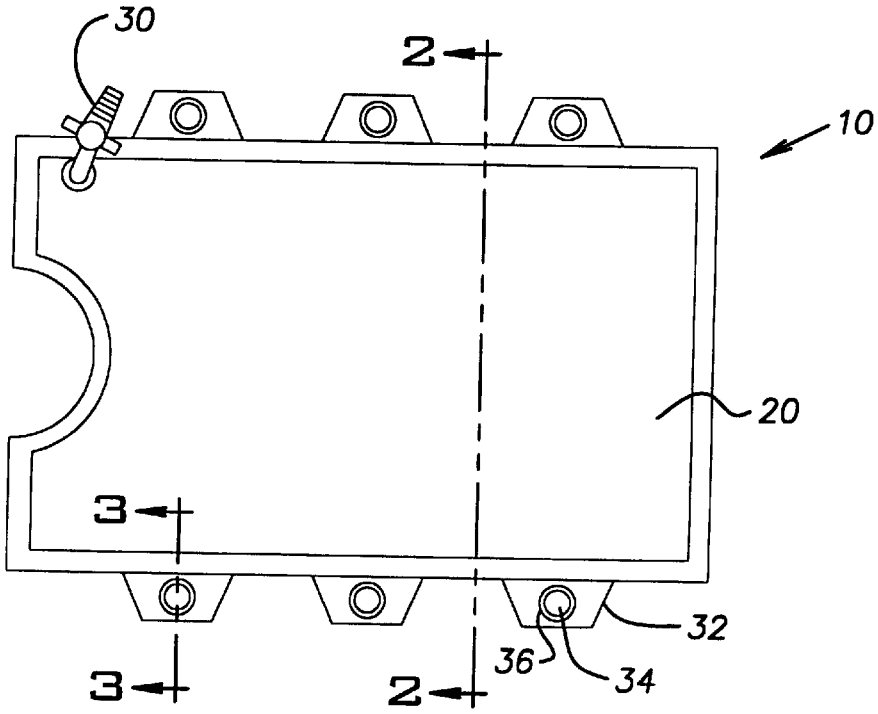
FIG. 1 is plan view of a gel pad assembly having a gel pad with an integral shape retainer according to a first embodiment of the present invention which can be adjusted to a variety of desired shapes.
Figure 2:
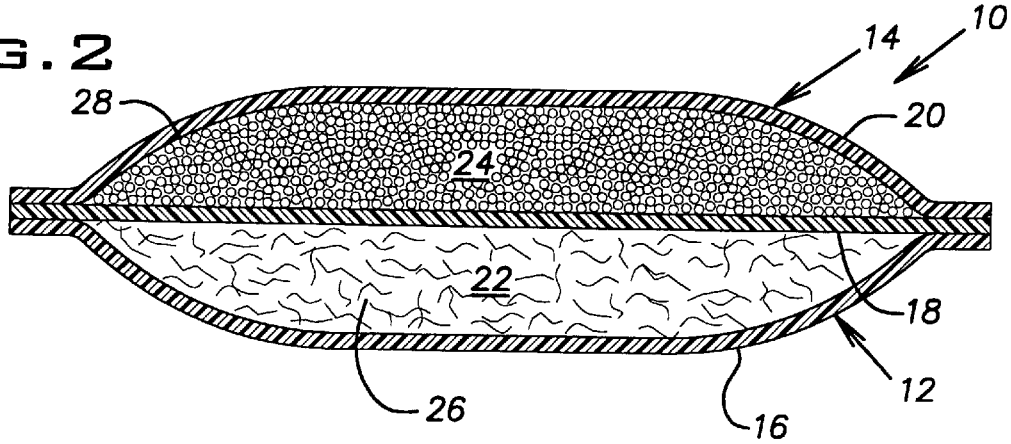
FIG. 2 is an enlarged cross-sectional view of the gel pad assembly of FIG. 1 taken along line 2—2 of FIG. 1.
Figure 3:
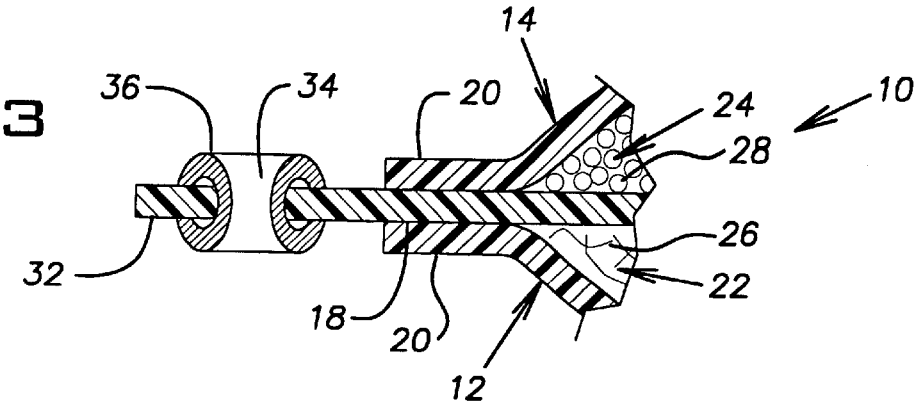
FIG. 3 is an enlarged cross-sectional view of the gel pad assembly of FIG. 1 taken along line 2—2 of FIG. 1.

FIGS. 1–3 illustrate a gel pad assembly 10 according to the present invention which includes a gel pad 12 for cushioning a portion of a patient's body and an integral shape retainer 14 for selectively adjusting or conforming the gel pad 12 to one of a wide variety of desired shapes and retaining the gel pad 12 in the desired shape. The illustrated gel pad assembly 10 includes three generally parallel sheets or walls 16, 18, 20 which are joined along each of their edges.

The walls 16, 18, 20 form a first sealed, hollow, interior cavity or chamber 22 for the gel pad 12 and a second sealed, hollow, interior cavity or chamber 24 for the shape retainer 14. The first and second chambers 22, 24 are preferably co-extensive and contiguous. A first outer wall 16 cooperates with an inner or central wall 18 to form the first chamber 22. A second outer wall 20 cooperates with the inner wall 18 to form the second chamber 24. Preferably, the first and second chambers 22, 24 share the common inner wall 18. It is noted, however, that additional outer and/or inner walls can alternatively be provided.

The walls 16, 18, 20 are secured together with a seal which extends about the entire periphery of the walls 16, 18, 20. The seal can be formed in any suitable manner to provide an adequate mechanical joint and fluid-tight seal, such as, for example, a thermal or heat weld, a radio frequency (RF) seal, or an adhesive. Note that the first chamber 22 of the first embodiment of the gel pad assembly 10 requires a liquid-tight seal or joint and the second chamber 24 requires an air-tight seal or joint. It is preferable, however, for each of the chambers 22, 24 to have an air-tight seal or joint.

In the illustrated embodiment, each of the chambers 22, 24 have a single uninterrupted volume. It is noted, however, that each of the chambers 22, 24 can alternatively be divided into smaller subchambers and/or can have void areas and/or openings therein. The subchambers, voids, and/or openings can be formed by additional seals between the sheets. Additionally, each of the chambers 22, 24 can be provided with inserts or baffles within the chambers 22, 24.

Each of the walls 16, 18, 20 comprise a flexible, air-impervious membrane material of any suitable type. Preferably, the air-impervious membrane material is a thermoplastic material so as to permit the walls 16, 18, 20 to be heat-sealed together. The walls 16, 18, 20 are flexible to allow both the gel pad 12 and the shape retainer 14 to be formed into a number of desirable shapes. Flexibility is important to permit the gel pad assembly 10 to be bent, twisted, and otherwise manipulated when the patent's body is being moved to a desired position. Suitable thermoplastic materials include soft polyvinyl chloride, nylon, polypropylene, polyethylene, fluoropolymers, urethane, copolymers of polyvinyl chloride and vinyl acetate, silicon rubber, and mixtures of polyvinyl chloride and synthetic rubber. The thermoplastic material may also be composed of a composite, such as a woven nylon material with a protective coating of urethane or vinyl.

The gel pad 12 further comprises a gel 26 disposed within the first chamber 22. The gel 26 can be of any suitable type but is preferably a semi-rigid or viscous gel. The gel 26 can advantageously be a semi-rigid colloidal dispersion of a solid with a liquid which retains heat or cold depending on the temperature to which the gel 26 has been subjected.

The shape retainer 14 further includes granules, pellets, beads or the like 28 which are disposed in the second chamber 24 and a valve 30 for selectively providing fluid-flow communication with the second chamber 24. The beads 28 partially fill the second chamber 24 and pack together to form a rigid mass when subjected to a vacuum. The beads 28 should be sufficiently rigid to withstand the stresses which occur when the beads 28 engage each other upon application of a vacuum, and should have a high mechanical strength to prevent the beads 28 from fracturing or breaking apart after repeated use of the gel pad assembly 10. In addition, the beads 28 should be elastically deformable to permit the beads to pack together tightly when a vacuum is applied.

The beads 28 can be of any suitable material, shape and quantity such that the beads 28 are free to move or flow within the second chamber 24 to obtain a desired shape or contour and retain the shape or contour when the second chamber 24 is evacuated as described in more detail hereinafter. When under vacuum, the beads become "hardened" and maintain the contour of the body portion to which the gel pad assembly 10 is engaged.

The beads 28 may be composed of a solid or expanded plastic material. Preferably, the beads 28 are composed of expanded polystyrene or polyvinyl chloride because expanded polystyrene and polyvinyl chloride have high mechanical strength, elastic deformability, and low specific gravity. More specifically, the beads 28 are composed of expanded polystyrene.

Preferably, the beads 28 have a diameter in a range from about 1 mm to about 10 mm, more preferably from about 5 mm to about 10 mm. The beads 28 may have a uniform size and shape, or a variety of sizes and shapes. It is believed that beads having a variety of sizes and shapes provide more uniform and stable support. In addition, commercially available beads 28 tend to have a variety of sizes and shapes. Accordingly, it is preferred if the beads 28 have a variety of sizes and shapes. Preferably, the beads 28 have a low density, in the range of about 0.5 $lbs/ft^3$ to about 2.0 $lbs/ft^3$, more preferably from about 1 $lbs/ft^3$ to about 2.0 $lbs/ft^3$, these ranges being given for the bulk density of a given volume of beads 28 packed together without compression.

The valve 30 is provided in the second outer wall 20 to selectively provide fluid-flow communication with the second chamber 24. The valve 30 is adapted to be connected with a line of a common vacuum pump so that when the valve 30 is open, a vacuum can be pulled within the second chamber 24. When the valve 30 is closed to seal the second chamber 24 prevent fluid-flow communication with the second chamber 24, the vacuum pump can be removed and the vacuum within the second chamber is maintained. If needed, the valve 30 is provided with a fine mesh wire screen to prevent the beads 28 from passing through the valve 30 when a vacuum is applied to the valve 30.

When the second chamber 24 is not under vacuum, that is, generally at atmospheric pressure, the beads 28 are free to flow or move within the second chamber 24 so that the gel pad 12 will conform to any desirable shape. When a vacuum is pulled in the second chamber 24, however, the beads 28 are pulled together in a rigid manner so that the beads 28 cannot move or flow relative to one another and the desired shape of the gel pad 12 is retained. To change the shape of the gel pad 12, the vacuum in the second chamber 24 is released by opening the valve 30 and releasing the vacuum, that is, bringing the second chamber 24 to atmospheric pressure so that the beads 28 are free to move or flow relative to another.

The vacuum source may be a portable manually-actuated vacuum pump, or a small electrical vacuum pump dedicated to the gel pad assembly 10 and located proximate to the gel pad assembly 10, or a large vacuum pump that provides a vacuum to a plurality of devices and is located remote from the gel pad assembly 10, such as the basement of a building. Preferably, the vacuum source provides a vacuum of about 10 to 100 mm Hg, and more preferably about 10 to 50 mm Hg.

The gel pad assembly 10 is preferably provided with at least one clip flap 32 and more preferably a plurality of spaced apart clip flaps 32 located along the edges of the gel pad assembly. The clip flaps 32 are preferably an extension of one or more of the walls 16, 18, 20. In the illustrated embodiment, the flaps are an extension of the inner wall 18. The clip flaps 32 are preferably outside of the seal, that is, the clip flaps 32 do not form a portion of the sealed chambers 22, 24 so that a puncture or tear in the clip flaps 32 does not compromise the sealed chambers 22, 24. The clip flaps 32 are preferably sized to provide an attachment point for conveniently clipping medical instruments thereto without endangering the sealed chambers 22, 24. The clip flaps 32 can be provided with suitable openings 34 for attachment cords or the like. Preferably, the openings 34 are provided with grommets 36 to prevent tearing of the clip flaps 32.

Figure 4:
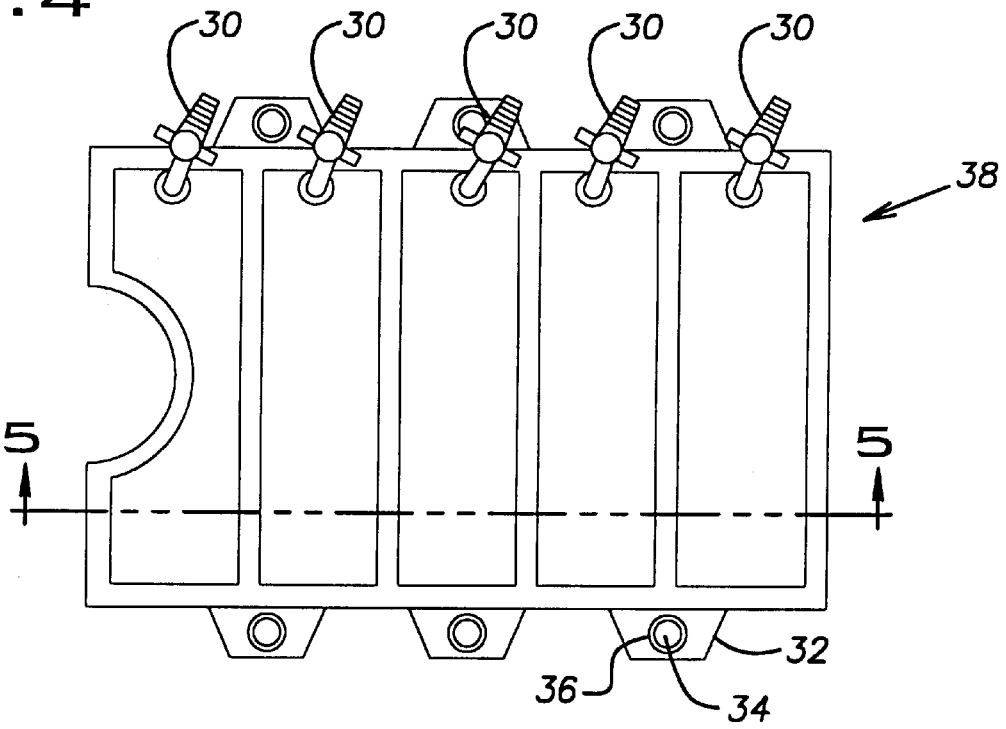
FIG. 4 is plan view of a gel pad assembly having a gel pad with an integral shape retainer according to a second embodiment of the present invention which can be adjusted to a variety of desired shapes.
Figure 5:
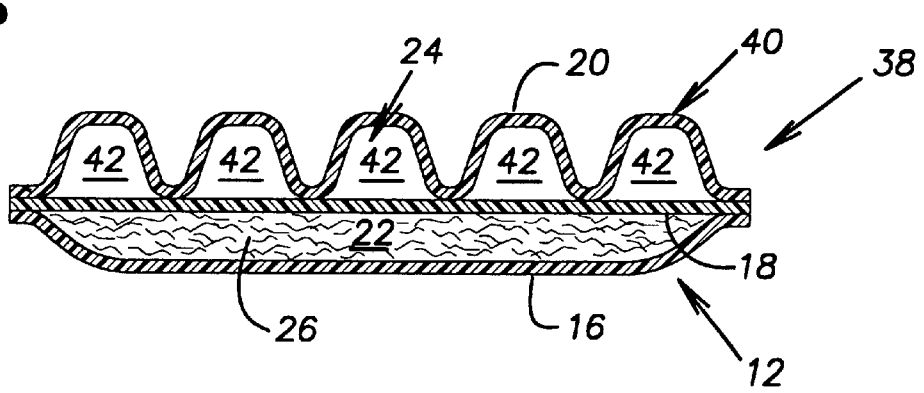
FIG. 5 is an enlarged cross-sectional view of the gel pad assembly of FIG. 4 taken along line 5—5 of FIG. 4.

FIGS. 4 and 5 illustrate a gel pad assembly 38 according to a second embodiment of the present invention wherein like numbers are used for like structure. The gel pad assembly 38 includes a gel pad 12 and an integral shape retainer 40 for selectively adjusting or conforming the gel pad 12 to one of a wide variety of desired shapes and retaining a desired shape of the gel pad 12. The gel pad assembly 38 illustrates that the shape retainer can be selectively adjusted by supplying pressurized fluid, such as air, rather than pulling a vacuum as described in more detail hereinbelow.

The illustrated gel pad assembly 38 includes three generally parallel sheets or walls 16, 18, 20 which are sealed along each of their edges. The walls 16, 18, 20 form a first sealed, hollow, interior cavity or chamber 22 for the gel pad 12 and a second sealed, hollow, interior cavities or chambers 24 opposite the first chamber 22 for the shape retainer 40. The second chamber 24 is divided into a plurality of separate sealed, hollow interior cavities or chambers 42. Preferably, the individual chambers 42 generally extend the entire width of the gel pad assembly 38 (best shown in FIG. 4). It is noted however that the individual chambers 42 can alternatively be of other shapes and sizes. It is also noted that there can be a greater or lesser number of the individual chambers than the illustrated embodiment with five chambers 42. It is apparent, however, that more than one individual chamber 42 is required for the chambers 42 to retain the gel pad assembly 38 in a variety of different shapes.

The first chamber 22 and the plurality of chambers 42 are preferably co-extensive and contiguous. A first outer wall 16 cooperates with an inner or central wall 18 to form the first chamber 22. A second outer wall 20 cooperates with the inner wall 18 to form the plurality of chambers 42. Preferably, the chambers 22, 42 share the common inner wall 18. It is noted, however, that additional outer and/or inner walls can alternatively be provided.

The walls 16, 18, 20 are secured together with a joint which extends about the entire periphery of each of the chambers 22, 42. The seal can be formed in any suitable manner to provide an adequate mechanical joint and fluid-tight seal, such as, for example, a thermal or heat weld, a radio frequency (RF) seal, or an adhesive. Note that for the second embodiment of the gel pad assembly 38, the first chamber 22 requires a liquid-tight seal or joint and each of the plurality of chambers 42 requires an air-tight seal or joint. It is preferable, however, for each of the chambers 22, 24 to have an air-tight seal or joint.

In the second embodiment of the gel pad assembly 38, the first chamber 22 has a single uninterrupted volume. It is noted, however, that the first chamber 22 can alternatively be divided into smaller subchambers and/or can have void areas and/or openings therein. The subchambers, voids, and/or openings can be formed by additional seals between the sheets. Additionally, the chambers 22, 42 can be provided with inserts or baffles.

Each of the walls 16, 18, 20 comprise a flexible, air-impervious membrane material of any suitable type. Preferably, the air-impervious membrane material is a thermoplastic material so as to permit the walls 16, 18, 20 to be heat-sealed together. The walls 16, 18, 20 are flexible to allow both the gel pad 12 and the shape retainer 40 to be formed into a number of desirable shapes. Flexibility is important to permit the gel pad assembly 38 to be bent, twisted, and otherwise manipulated when the patent's body is being moved to a desired position. Suitable thermoplastic materials include soft polyvinyl chloride, nylon, polypropylene, polyethylene, fluoropolymers, urethane, copolymers of polyvinyl chloride and vinyl acetate, silicon rubber, and mixtures of polyvinyl chloride and synthetic rubber. The thermoplastic material may also be composed of a composite, such as a woven nylon material with a protective coating of urethane or vinyl.

The gel pad 12 further comprises a gel 26 disposed within the first chamber 22. The gel 26 can be of any suitable type but is preferably a semi-rigid or viscous gel. The gel 26 can advantageously be a semi-rigid colloidal dispersion of a solid with a liquid which retains heat or cold depending on the temperature to which the gel 26 has been subjected.

The shape retainer 40 further includes and a plurality of valves 30 for selectively providing fluid-flow communication with each of the individual chambers 42.

The valves 30 are provided in the second outer wall 20 to selectively provide fluid-flow communication with the individual chambers 24. The valves 30 are adapted to be connected with a line of a common pump so that when the valve 30 is open, pressurized air can flow into the selected one of the individual chambers 42. When the valve 30 is closed to seal the chamber 42 and prevent fluid-flow communication with the chamber 42, the pump can be removed and the pressurization of the chamber 42 is maintained.

The compressed-air source may be a portable manually-actuated vacuum pump, or a small electrical air compressor dedicated to the gel pad assembly 38 and located proximate to the gel pad assembly 38, or a large air compressor that provides compressed air to a plurality of devices and is located remote from the gel pad assembly 38, such as the basement of a building. Preferably, the vacuum source provides a vacuum of about 10 to 100 mm Hg above atmospheric pressure, and more preferably about 10 to 50 mm Hg above atmospheric pressure.

When the individual chambers 42 are not pressurized, that is, at atmospheric pressure, the gel pad 12 will conform to any desirable shape. When pressurized, the individual chamber 42 becomes rigid or "hardened". Therefore, by pressurizing selected ones of the individual chambers 42 a wide variety of desired shapes or contours for the gel pad 12 can be obtained and maintained. To again change the shape of the gel pad 12, the pressurization in the individual chambers 42 is released by opening the valves 30, that is, bringing the individual chambers 42 to atmospheric pressure so that the gel pad is completely free to change its shape or contour.

Figure 6:
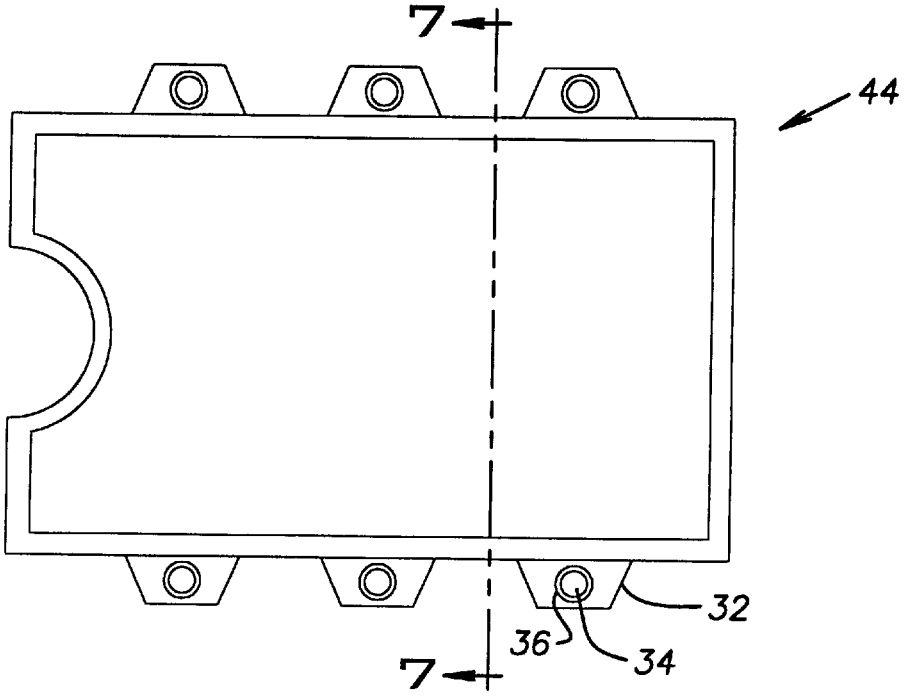
FIG. 6 is plan view of a gel pad assembly having a gel pad with an integral shape retainer according to a third embodiment of the present invention which can be adjusted to a variety of desired shapes.
Figure 7:
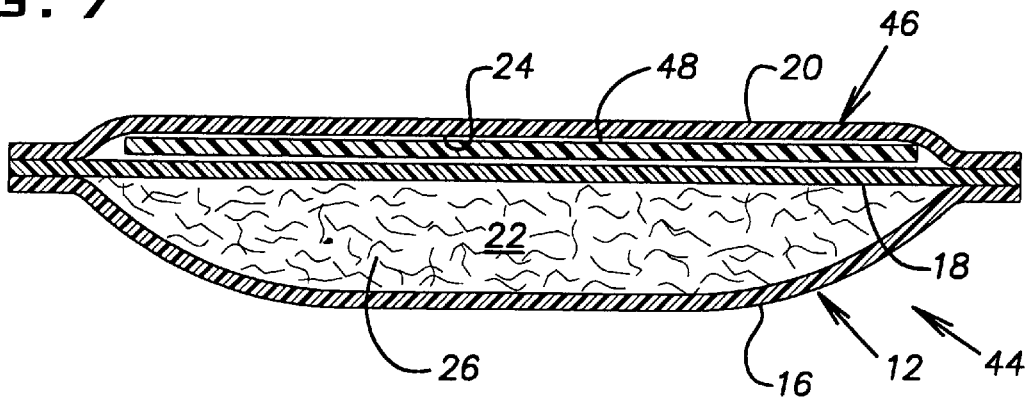
FIG. 7 is an enlarged cross-sectional view of the gel pad assembly of FIG. 6 taken along line 7—7 of FIG. 6.

FIGS. 6 and 7 illustrate a gel pad assembly 44 according to a third embodiment of the present invention wherein like numbers are used for like structure. The gel pad assembly 44 includes a gel pad 12 and integral shape retainer 46 for selectively adjusting or conforming the gel pad 12 to one of a wide variety of desired shapes and retaining the desired shape of the gel pad 12. The gel pad assembly 44 illustrates that the shape retainer 46 can be selectively adjusted by supplying heat rather than by pulling a vacuum or supplying pressurized air as described in more detail hereinbelow. The third embodiment is particularly desirable because a pump, and possibly electricity, is not required to adjust the shape retainer 46.

The illustrated gel pad assembly 44 includes three generally parallel sheets or walls 16, 18, 20 which are joined along each of their edges. The walls 16, 18, 20 form a first sealed, hollow, interior cavity or chamber 22 for the gel pad 12 and a second sealed, hollow, interior cavity or chamber 24 for the shape retainer 46. The first and second chambers 22, 24 are preferably co-extensive and contiguous. A first outer wall 16 cooperates with an inner or central wall 18 to form the first chamber 22. A second outer wall 20 also cooperates with the inner wall 18 to form the second chamber 24. Preferably, the first and second chambers 22, 24 share the common inner wall 18. It is noted, however, that additional outer and/or inner walls can alternatively be provided.

The walls 16, 18, 20 are secured together with a seal which extends about the entire periphery of the walls 16, 18, 20. The seal can be formed in any suitable manner to provide an adequate mechanical joint and fluid-tight seal, such as, for example, a thermal or heat weld, a radio frequency (RF) seal, or an adhesive. Note that for the illustrated embodiment, the first chamber 22 requires a liquid-tight seal or joint but the second chamber 24 does is not required to be sealed. It is preferable, however, for each of the chambers 22, 24 to have a gas-tight seal or joint.

In the illustrated embodiment, each of the chambers 22, 24 have a single uninterrupted volume. It is noted, however, that either chamber 22, 24 can alternatively be divided into smaller subchambers and/or can have void areas and/or openings therein. The subchambers, voids, and/or openings can be formed by additional seals between the sheets. Additionally, each of the chambers 22, 24 can be provided with inserts or baffles within the chambers 22, 24.

Each of the walls 16, 18, 20 comprise a flexible, air-impervious membrane material of any suitable type. Preferably, the air-impervious membrane material is a thermoplastic material so as to permit the walls 16, 18, 20 to be heat-sealed together. The walls 16, 18, 20 are flexible to allow both the gel pad 12 and the shape retainer 46 to be formed into a number of desirable shapes. Flexibility is important to permit the gel pad assembly 44 to be bent, twisted, and otherwise manipulated when the patent's body is being moved to a desired position. Suitable thermoplastic materials include soft polyvinyl chloride, nylon, polypropylene, polyethylene, fluoropolymers, urethane, copolymers of polyvinyl chloride and vinyl acetate, silicon rubber, and mixtures of polyvinyl chloride and synthetic rubber. The thermoplastic material may also be composed of a composite, such as a woven nylon material with a protective coating of urethane or vinyl.

The gel pad 12 further comprises a gel 26 disposed within the first chamber 22. The gel 26 can be of any suitable type but is preferably a semi-rigid or viscous gel. The gel 26 can advantageously be a semi-rigid colloidal dispersion of a solid with a liquid which retains heat or cold depending on the temperature to which the gel 26 has been subjected.

The shape retainer 46 includes a thermoplastic sheet 48 located within the second chamber and generally parallel with the walls 16, 18, 20. The sheet 48 can comprise any suitable thermoplastic material which is generally rigid or hard when cooled to near room temperature but generally flexible or soft when heated to elevated temperatures such as, for example polystyrene or polyethylene. The sheet 48 is sized and shaped so that it will flex or bend to obtain a desired shape or contour when heated and retain the shape or contour when cooled to near room temperature. Therefore, when cooled the sheet 48 becomes "hardened" and maintains the contour of the item to which the gel pad assembly 44 is engaged. To again change the shape of the gel pad 12, the sheet 48 is simply reheated to its flexure temperature and it again becomes flexible.

The sheet 48 can be heated by any known means such as, for example, blowing a stream of hot air over the second outer wall. Additionally, the second outer wall 20 can be provided with inlet and outlets so that hot fluid can be provided to the second chamber to directly heat the sheet 48. It is noted that the shape retainer 46 can also be provided with an integral heating means such as, for example, an electric film heater secured to the wall of the sheet 48. It is noted that the materials of sheet 48 and the walls 16, 18, 20 must be selected so that the sheet 48 is softened at a temperature which does not affect the seal formed by the walls 16, 18, 20.

Figure 8:
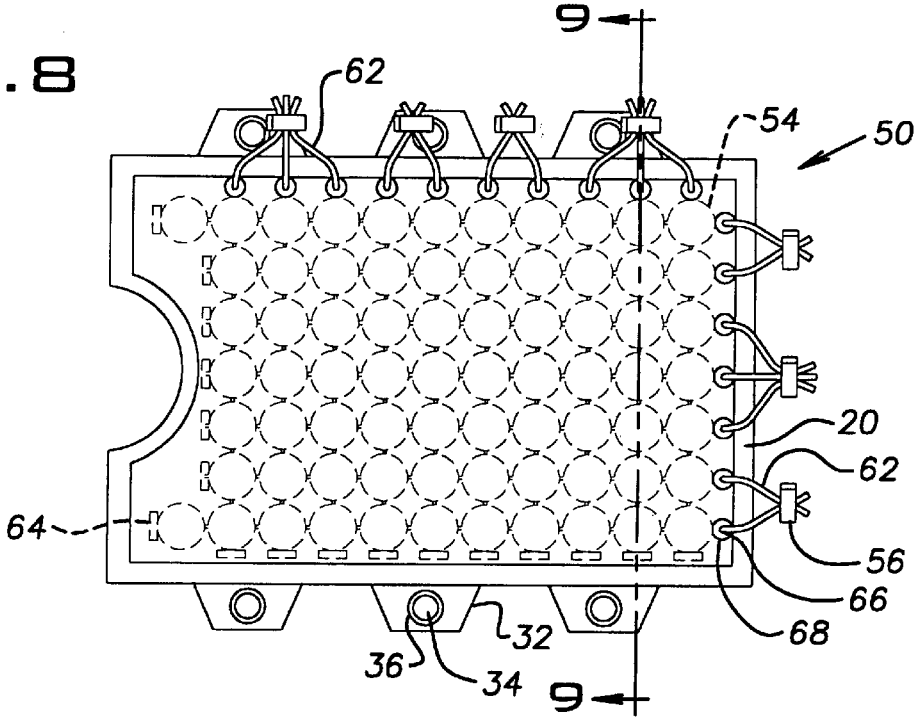
FIG. 8 is plan view of a gel pad assembly having a gel pad with an integral shape retainer according to a fourth embodiment of the present invention which can be adjusted to a variety of desired shapes.
Figure 9:
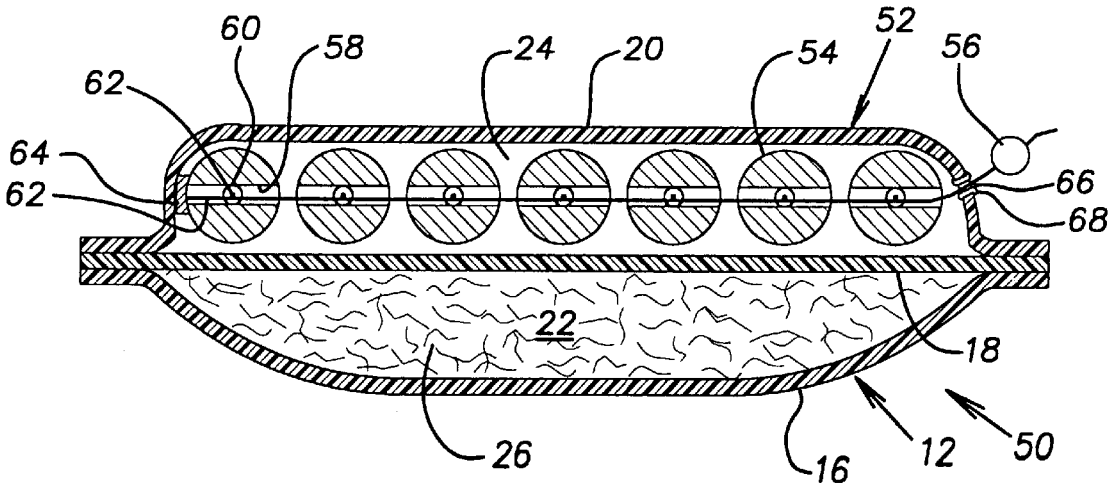
FIG. 9 is an enlarged cross-sectional view of the gel pad assembly of FIG. 8 taken along line 9—9 of FIG. 8.

FIGS. 8 and 9 illustrate a gel pad assembly 50 according to a fourth embodiment of the present invention wherein like numbers are used for like structure. The gel pad assembly 50 includes a gel pad 12 and integral shape retainer 52 for adjusting or conforming the gel pad 12 to one of a wide variety of desired shapes and selectively retaining the desired shape of the gel pad 12. The gel pad assembly 50 illustrates that the shape retainer 52 can be selectively adjusted mechanically rather than by pulling a vacuum, supplying pressurized air, or supplying heat as described in more detail hereinbelow. The fourth embodiment is particularly desirable because a pump or electricity is not required to adjust the shape retainer 52.

The illustrated gel pad assembly 50 includes three generally parallel sheets or walls 16, 18, 20 which are sealed along each of their edges. The walls 16, 18, 20 form a first sealed, hollow, interior cavity or chamber 22 for the gel pad 12 and a second sealed, hollow, interior cavity or chamber 24 for the shape retainer 52. The first and second chambers 22, 24 are preferably co-extensive and contiguous. A first outer wall 16 cooperates with an inner or central wall 18 to form the first chamber 22. A second outer wall 20 also cooperates with the inner wall 18 to form the second chamber 24. Preferably, the first and second chambers 22, 24 share the common inner wall 18. It is noted, however, that additional outer and/or inner walls can alternatively be provided.

The walls 16, 18, 20 are secured together with a joint which extends about the entire periphery of the walls 16, 18, 20. The seal can be formed in any suitable manner to provide an adequate mechanical joint and fluid-tight seal, such as, for example, a thermal or heat weld, a radio frequency (RF) seal, or an adhesive. Note that for the illustrated embodiment, the first chamber 22 requires a liquid-tight seal or joint but the second chamber 24 is not required to be sealed. It is preferable, however, for each of the chambers 22, 24 to have an air-tight seal or joint.

In the illustrated embodiment, each of the chambers 22, 24 have a single uninterrupted volume. It is noted, however, that either chamber 22, 24 can alternatively be divided into smaller subchambers and/or can have void areas and/or openings therein. The subchambers, voids, and/or openings can be formed by additional seals between the sheets. Additionally, each of the chambers 22, 24 can be provided with inserts or baffles within the chambers 22, 24.

Each of the walls 16, 18, 20 comprise a flexible, air-impervious membrane material of any suitable type. Preferably, the air-impervious membrane material is a thermoplastic material so as to permit the walls 16, 18, 20 to be heat-sealed together. The walls 16, 18, 20 are flexible to allow both the gel pad 12 and the shape retainer 52 to be formed into a number of desirable shapes. Flexibility is important to permit the gel pad assembly 50 to be bent, twisted, and otherwise manipulated when the patent's body is being moved to a desired position. Suitable thermoplastic materials include soft polyvinyl chloride, nylon, polypropylene, polyethylene, fluoropolymers, urethane, copolymers of polyvinyl chloride and vinyl acetate, silicon rubber, and mixtures of polyvinyl chloride and synthetic rubber. The thermoplastic material may also be composed of a composite, such as a woven nylon material with a protective coating of urethane or vinyl.

The gel pad 12 further comprises a gel 26 disposed within the first chamber 22. The gel 26 can be of any suitable type but is preferably a semi-rigid or viscous gel. The gel 26 can advantageously be a semi-rigid colloidal dispersion of a solid with a liquid which retains heat or cold depending on the temperature to which the gel 26 has been subjected.

The shape retainer 52 includes a plurality of elements 54 pivotally connected to one another to conform to a variety of different shapes or contours and clamps 56 for securing the pivot elements against relative movement to retain the pivot elements in a desired shape. The pivot elements 54 are located within the second chamber 24 and are arranged in adjacent rows and columns. The pivot elements 54 of the illustrated embodiment are generally spherical shaped and each has first and second passages 58, 60 perpendicularly extending therethrough. A plurality of cords or lines 62 connect the pivot elements 54. One of the connecting lines 62 extends through the first passages 58 of the pivot elements 54 in each column. One of the connecting lines 62 also extends through the second passages 60 of the pivot elements 54 in each row. One end of each connecting line 62 is provided with an anchor 64 which prevents the end of the connecting line 62 from passing through the passages 58, 60 when pulled. The other end of each connecting line 62 passes through an opening 66 in the second outer wall 20 to one of the clamps 56. It is noted that a separate one of the clamps 56 can be provided for each of the connecting lines 62 or some of the connecting lines can utilize common clamps as illustrated in FIG. 8. The openings 66 are preferably provided with grommets 68.

When the clamps 56 are adjusted so that there is slack in the connecting lines 62, the pivot elements 54 are free to move to obtain a desired shape or contour. When the clamps 56 are adjusted to remove any slack in the connecting lines 62, the pivot elements 54 cannot move and the shape retainer is rigid to retain the desired shape or contour. When secured by the clamps 56, the pivot elements 54 collectively become "hardened or rigid" and maintain the contour of the item to which the gel pad assembly 50 is engaged. To change the shape of the gel pad 12, the clamps are released to provide slack in the connecting lines 62 so that the pivot elements 54 are free to move and pivot relative to another.

The above description of preferred embodiments illustrates that the present invention provides an improved gel pad having an integral shape retainer which is selectively adjustable between a flexible condition wherein the gel pad is conformable to a variety of desired shapes and a rigid condition wherein the gel pad is retained in a selected one of the desired shapes. Additionally, the improved gel pad according to the present invention has no separate or loose components, is relatively inexpensive to produce, and is simple to operate.

Although particular embodiments of the invention have been described in detail, it will be understood that the invention is not limited correspondingly in scope, but includes all changes and modifications coming within the spirit and terms of the claims appended hereto.

What is claimed is:

1. A gel pad comprising:

a flexible inner wall;

a flexible first outer wall cooperating with said inner wall to form a first chamber;

gel located within said first chamber;

a flexible second outer wall cooperating with said inner wall to form a second chamber coextensive with said first chamber; and an integral shape retainer located within said second chamber and selectively adjustable between a flexible condition wherein said flexible walls are conformable to a variety of desired shapes and a rigid condition wherein said flexible walls are retained in a selected one of the desired shapes;

wherein said shape retainer includes a plurality of beads located within said second chamber and a valve selectively providing fluid-flow communication with the second chamber.

2. The gel pad according to claim 1, wherein said first and second chambers are contiguous.

3. The gel pad according to claim 1, wherein said valve is located in said second wall.

4. The gel pad according to claim 1, wherein said first chamber is provided with at least a fluid-tight seal and said second chamber is provided with at least an air-tight seal.

5. The gel pad according to claim 1, wherein said shape retainer includes a plurality of individual chambers located within said second chamber and a plurality of valves selectively providing fluid-flow communication with the individual chambers.

6. The gel pad according to claim 5, wherein said valves are located in said second wall.

7. The gel pad according to claim 5, wherein said first chamber is provided with at least a fluid-tight seal and said individual chambers are each provided with at least an air-tight seal.

8. The gel pad according to claim 5, wherein each of said individual chambers substantially extend across a width of the second outer wall.

9. A gel pad comprising:

a flexible inner wall;

a flexible first outer wall cooperating with said inner wall to form a first chamber;

gel located within said first chamber;

a flexible second outer wall cooperating with said inner wall to form a second chamber coextensive with said first chamber; and means for selectively retaining said walls in a selected one of a variety of desired shapes;

wherein said shape retainer means includes a plurality of beads located within said second chamber and a valve selectively providing fluid-flow communication with the second chamber.

10. The gel pad according to claim 9, wherein said valve is located in said second wall.

11. The gel pad according to claim 9, wherein said shape retainer means includes a plurality of individual chambers located within said second chamber and a plurality of valves selectively providing fluid-flow communication with the individual chambers.

* * * * *